US008306459B2

(12) United States Patent
Koiwai

(10) Patent No.: US 8,306,459 B2
(45) Date of Patent: Nov. 6, 2012

(54) OPENING-AND-CLOSING MECHANISM AND IMAGE FORMING APPARATUS

(75) Inventor: Hideo Koiwai, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 372 days.

(21) Appl. No.: 12/786,752

(22) Filed: May 25, 2010

(65) Prior Publication Data

US 2011/0158680 A1 Jun. 30, 2011

(30) Foreign Application Priority Data

Dec. 28, 2009 (JP) ..... 2009-298589

(51) Int. Cl.
*G03G 15/00* (2006.01)
*G03G 21/00* (2006.01)

(52) U.S. Cl. ..... 399/125; 399/124

(58) Field of Classification Search ..... 399/110, 399/124, 125
See application file for complete search history.

(56) References Cited

U.S. PATENT DOCUMENTS 5,860,044 A * 1/1999 Eki et al. ..... 399/125
6,055,394 A * 4/2000 Suda et al. ..... 399/125 X
7,433,629 B2 * 10/2008 Tomatsu ..... 399/125
2006/0029424 A1 2/2006 Kawai et al.
2008/0080893 A1 4/2008 Asahina et al.
2008/0184627 A1 * 8/2008 Hilger ..... 49/414
2008/0232847 A1 * 9/2008 Kusukawa et al. ..... 399/114

FOREIGN PATENT DOCUMENTS

JP 2006-044061 A 2/2006
JP 2006-229469 A 8/2006
JP 2007-279565 A 10/2007
JP 2008-090047 A 4/2008

* cited by examiner

*Primary Examiner* — Sandra Brase
(74) *Attorney, Agent, or Firm* — Sughrue Mion, PLLC

(57) ABSTRACT

An aspect of the invention is an opening-and-closing mechanism including: an opening-and-closing member that open-and-closes an body; a holding member rotatably coupled to the body; a sliding member disposed slidable to the holding member along a longitudinal-direction of the holding member, whose end portion is coupled to the opening-and-closing member, and sliding to the holding member in accompaniment with rotation of the opening-and-closing member; a braking member of an elastic material whose coefficient of friction with one of the sliding member or the holding member is larger than that between the other of the sliding member or the holding member and the one, the braking member sliding to the one in accompaniment with the sliding member sliding to the holding member to generate a braking-force by a frictional-force; and a pressing member disposed on the other, the braking member being mounted thereat, pressing the braking member against the one.

14 Claims, 18 Drawing Sheets

OPENING-AND-CLOSING MECHANISM AND IMAGE FORMING APPARATUS

CROSS-REFERENCE TO RELATED APPLICATION

This application is based on and claims priority under 35 USC 119 from Japanese Patent Application No. 2009-298589 filed Dec. 28, 2009.

BACKGROUND

Technical Field

The present invention relates to an opening-and-closing mechanism and an image forming apparatus.

SUMMARY

An opening-and-closing mechanism of an aspect of the invention includes: an opening-and-closing member that rotates about a rotational center with respect to a body to thereby open and close one surface of the body; a holding member that is disposed on the body and is rotatably coupled in a position that is displaced in a vertical direction with respect to the rotational center; a sliding member that is disposed so as to be slidable with respect to the holding member along a longitudinal direction of the holding member, whose end portion is coupled to the opening-and-closing member, and that slides with respect to the holding member in accompaniment with rotation of the opening-and-closing member; a braking member that is formed by a material that has elasticity and whose coefficient of friction with one of the sliding member or the holding member is larger than a coefficient of friction between the other of the sliding member or the holding member and the one of the sliding member or the holding member, the braking member sliding with respect to the one of the sliding member or the holding member in accompaniment with the sliding member sliding with respect to the holding member to thereby generate a braking force by a frictional force with the one of the sliding member or the holding member; and a pressing member that is disposed on the other of the sliding member or the holding member, the braking member being mounted at the pressing member, and the pressing member pressing the braking member against the one of the sliding member or the holding member.

BRIEF DESCRIPTION OF THE DRAWINGS

Exemplary embodiments of the invention will be described in detail with reference to the following figures, wherein.

DETAILED DESCRIPTION

Exemplary embodiments of an image forming apparatus equipped with an opening-and-closing mechanism pertaining to the invention will be described on the basis of the drawings.

(Overall Configuration of Image Forming Apparatus)

First, the overall configuration of an image forming apparatus equipped with an opening-and-closing mechanism pertaining to a first exemplary embodiment will be described on the basis of FIG. 1.

Figure 1:
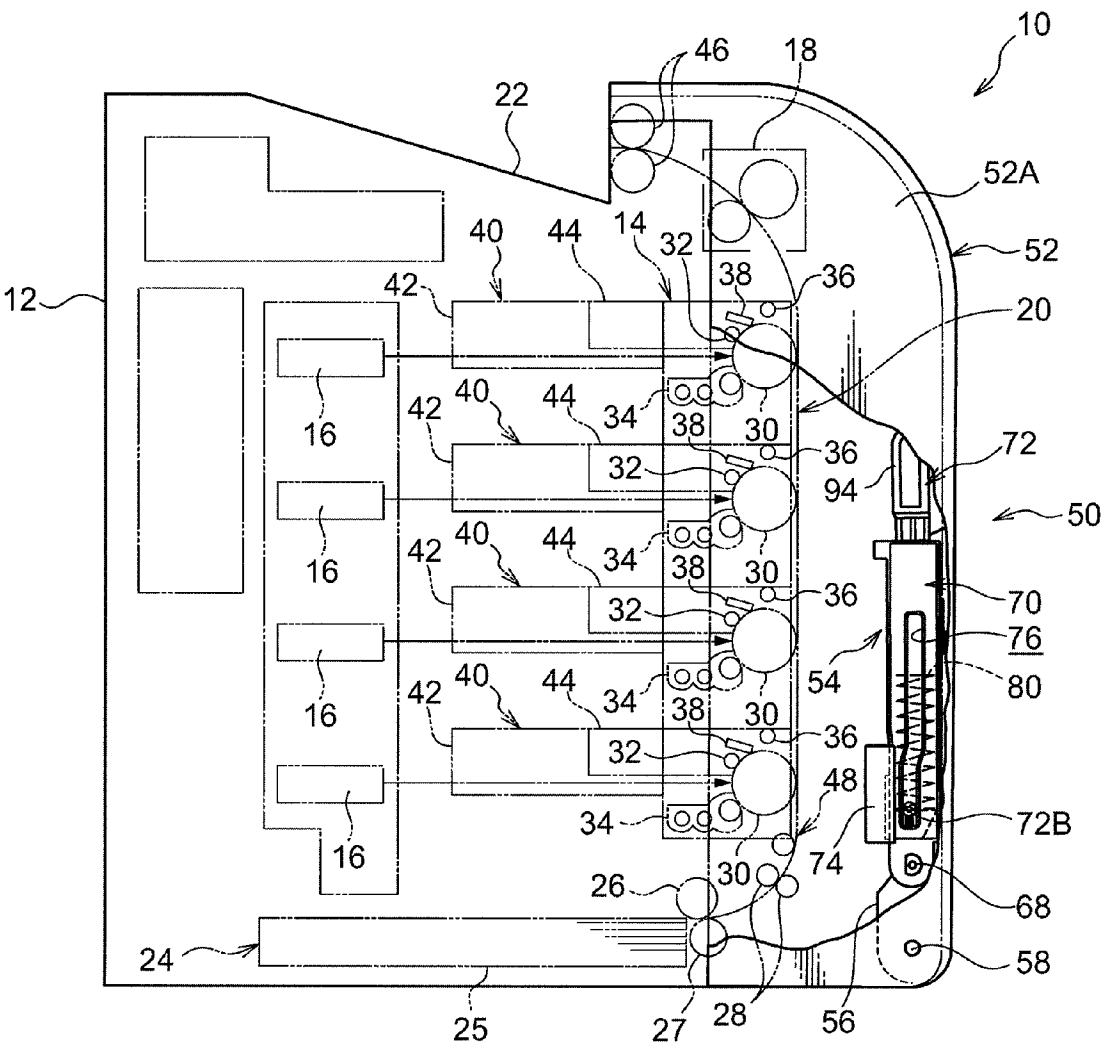
FIG. 1 is a general configuration diagram showing an image forming apparatus to which an opening-and-closing mechanism pertaining to a first exemplary embodiment is applied.

As shown in FIG. 1, an image forming apparatus 10 includes an image forming apparatus body 12. Inside the image forming apparatus body 12, there are placed photoreceptor units 14 serving as one example of image forming units, optical writing devices 16, a fixing device 18, and a transport unit 20. Further, a discharge unit 22 is formed in an upper portion of the image forming apparatus body 12, and a paper supply unit 24 is placed in a lower portion of the image forming apparatus body 12.

The paper supply unit 24 includes a paper cassette 25 in which plural recording sheets (recording medium) P are stacked and housed, and the paper cassette 25 is disposed so as to be loadable into and unloadable from the image forming apparatus body 12. Additionally, a feed roll 26 is placed above one end side (the right side in FIG. 1) of the paper cassette 25, and a retard roll 27 is disposed facing this feed roll 26.

Consequently, the uppermost recording sheet P in the paper cassette 25 is removed by the feed roll 26 and is handled and fed by the cooperation of the feed roll 26 and the retard roll 27. Then, the recording sheet P that has been fed is stopped temporarily and is then sequentially transported toward the photoreceptor units 14 by registration rolls 28 disposed on the paper transporting direction upstream side of the photoreceptor units 14.

Further, the photoreceptor units 14 are disposed for each of the colors of yellow (Y), magenta (M), cyan (C) and black (K) in order from the paper transporting direction upstream side, and a photoreceptor 30 is supported such that it can freely rotate in each of the photoreceptor units 14. Around each of the photoreceptors 30, there are disposed a charge roll 32 that uniformly charges the photoreceptor 30, a developing device 34 that develops, with a toner (a developer), a latent image that has been written (formed) on the photoreceptor 30, an eraser device 36 that erases the photoreceptor 30 after transfer, and a cleaning device 38 that removes toner remaining on the surface of the photoreceptor 30 after being transferred.

Additionally, the photoreceptor 30, the charge roll 32, the developing device 34, the eraser device 36 and the cleaning device 38 are integrated so that each of these photoreceptor units 14 is attachable to and detachable from the image forming apparatus body 12. Further, toner boxes 40, in which the toners of the respective colors supplied to the developing devices 34 are stored, are respectively connected to the back surface side (the left side in FIG. 1) of the photoreceptor units 14.

Each of the toner boxes 40 is configured as a result of a toner supply unit 42 and toner recovery unit 44 being integrated. The toner supply units 42 are connected to the developing devices 34 and supply the toners of the respective colors to the developing devices 34. Additionally, the toner recovery units 44 are connected to the cleaning devices 38 and recover the toners of the respective colors.

Moreover, the optical writing devices 16, which include laser exposure devices, are respectively disposed in positions corresponding to the photoreceptors 30 on the back surface side (the left side in FIG. 1) of the toner boxes 40. The optical writing devices 16 irradiate the surfaces of the photoreceptors 30 with laser beams to thereby form latent images on the surfaces of the photoreceptors 30.

Further, the fixing device 18 is disposed on the paper transporting direction downstream side of the photoreceptor units 14. The fixing device 18 applies heat and pressure to, and thereby fixes, the unfixed toner image on the recording sheet P. Additionally, discharge rolls 46 are disposed on the paper transporting direction downstream side of this fixing device 18. The discharge rolls 46 discharge the recording sheet P to which the toner image has been fixed onto the paper discharge unit 22.

Next, the image forming operation in the image forming apparatus 10 configured as described above will be described.

First, the uppermost recording sheet P in the paper cassette 25 is removed by the feed roll 26 and is handled and fed by the cooperation of the feed roll 26 and the retard roll 27. Then, the recording sheet P that has been fed is sequentially transported toward the photoreceptor units 14 by the registration rolls 28.

Meanwhile, in the photoreceptor unit 14, first, the surface (peripheral surface) of the photoreceptor 30 is uniformly charged by the charge roll 32. Then, laser beam is emitted from the optical writing device 16, the surface of the photoreceptor 30 is scanned, and latent image based on image data is formed on the surface of the photoreceptor 30. Thereafter, the latent image is developed with the toner by the developing device 34, and toner image (visible image) is formed on the surface of the photoreceptor 30.

The respective toner images are transferred in the order of yellow (Y), magenta (M), cyan (C) and black (K) onto the recording sheet P that is transported by the transport unit 20. The recording sheet P onto which a full-color toner image (unfixed image) has been transferred is transported to the fixing device 18. Then, the unfixed toner image that has been transferred onto the recording sheet P that has been supplied to the fixing device 18 is subjected to heat and pressure and thereby fixed, and the recording sheet P to which the toner image has been fixed is discharged onto the paper discharge unit 22 by the discharge rolls 46. After the toner images have been transferred to the recording sheet P, the surfaces of the photoreceptors 30 are cleaned by the cleaning devices 38 and prepared for the next image creating process.

(Opening-and-Closing Device)

Next, an opening-and-closing device 50 serving as one example of an opening-and-closing mechanism with which the image forming apparatus 10 of the first exemplary embodiment is equipped will be described on the basis of FIG. 1 to FIG. 14.

Figure 2:
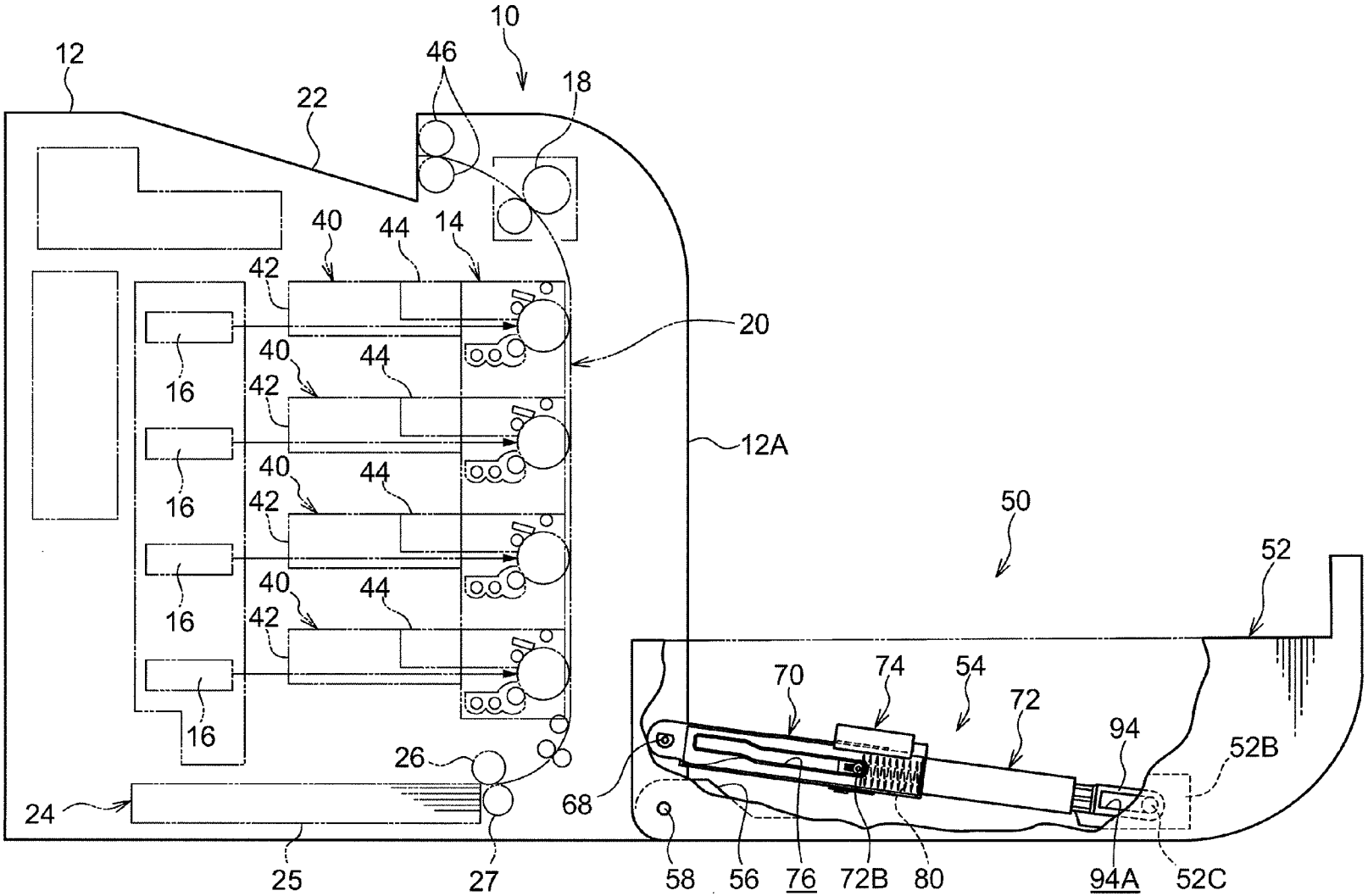
FIG. 2 is a general configuration diagram showing a state where an opening-and-closing cover of the image forming apparatus has been opened.
Figure 3:
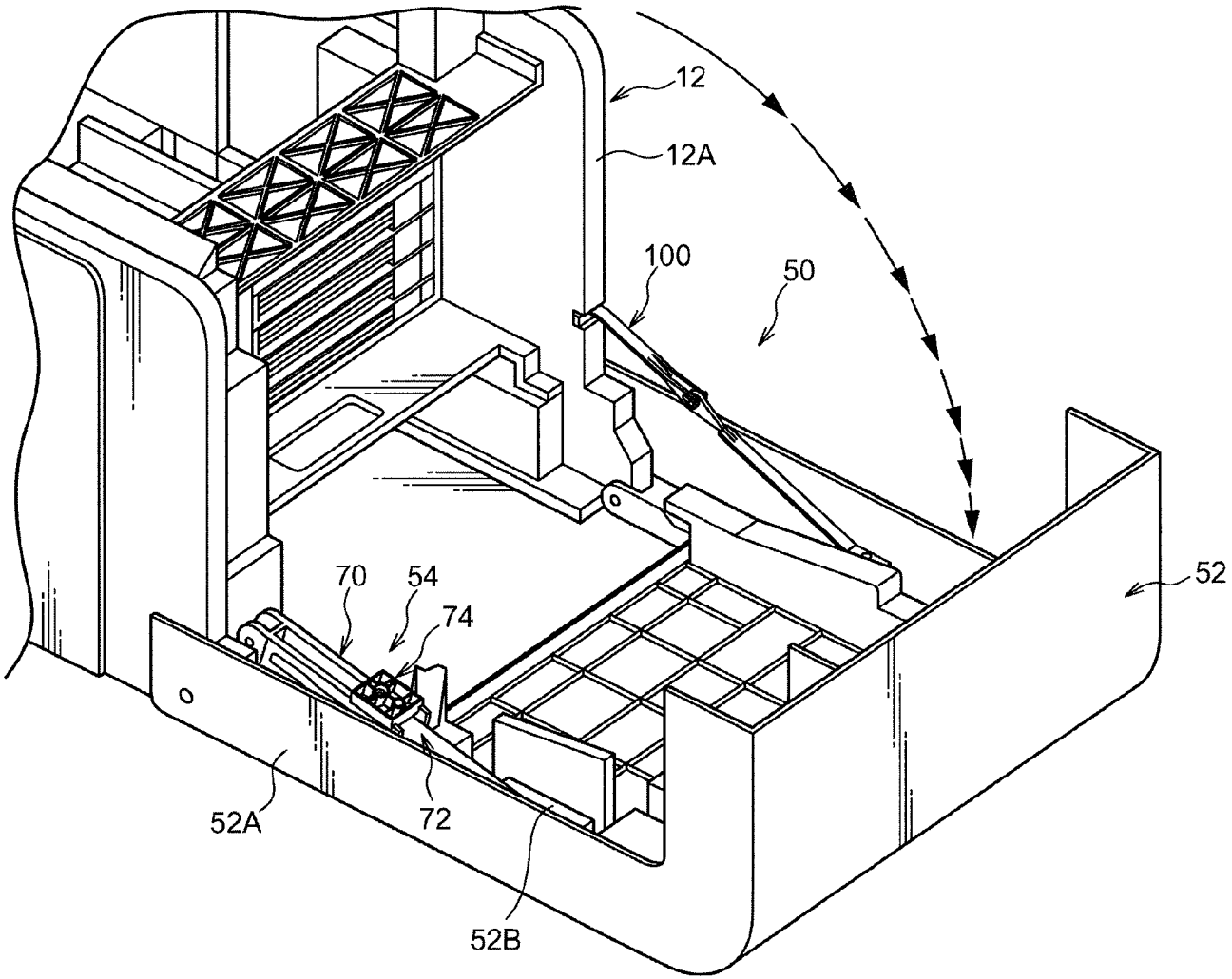
FIG. 3 is a general perspective diagram showing a damper device of the opening-and-closing mechanism when the opening-and-closing cover has been opened.

As shown in FIG. 1 to FIG. 3, the opening-and-closing device 50 is equipped with an opening-and-closing cover 52, which serves as one example of an opening-and-closing member that is disposed so as to be capable of opening and closing a right side surface 12A that is one surface of the image forming apparatus body 12 serving as one example of a body, and a damper device 54, which serves as a braking device that is provided to extend along an inner surface of this opening-and-closing cover 52 and allows the opening-and-closing cover 52 to gently (slowly) open and close. Mounting portions 56 disposed on both sides of a lower end portion of the opening-and-closing cover 52 are rotatably coupled to rotation support portions 58 disposed in the lower portion of the image forming apparatus body 12.

The damper device 54 is disposed along one of side portions in a width direction (the near side in FIG. 3) of the opening-and-closing cover 52. The damper device 54 is equipped with a holding member 70 that is rotatably coupled to a rotation support portion 68 disposed above the rotation support portion 58 of the image forming apparatus body 12, a sliding member 72 serving as one example of a sliding member that is disposed so as to be slidable with respect to the holding member 70, and a pressing (pushing) member 74 that is fixed above the sliding member 72 and slides integrally with the sliding member 72 with respect to the holding member 70.

When seen from the side, the rotation support portion 68 is disposed above the rotation support portion 58, which is rotational center of the mounting portion 56 of the opening-and-closing cover 52 with respect to the image forming apparatus body 12, and below a lowermost end 48 of the photoreceptor unit 14 that is pulled out from the image forming apparatus body 12 when the opening-and-closing cover 52 is opened. The damper device 54 has, as shown in FIG. 2 and FIG. 3, a configuration where it does not project upward from a side wall 52A of the opening-and-closing cover 52 when seen from the side when the opening-and-closing cover 52 has been opened.

Figure 4:
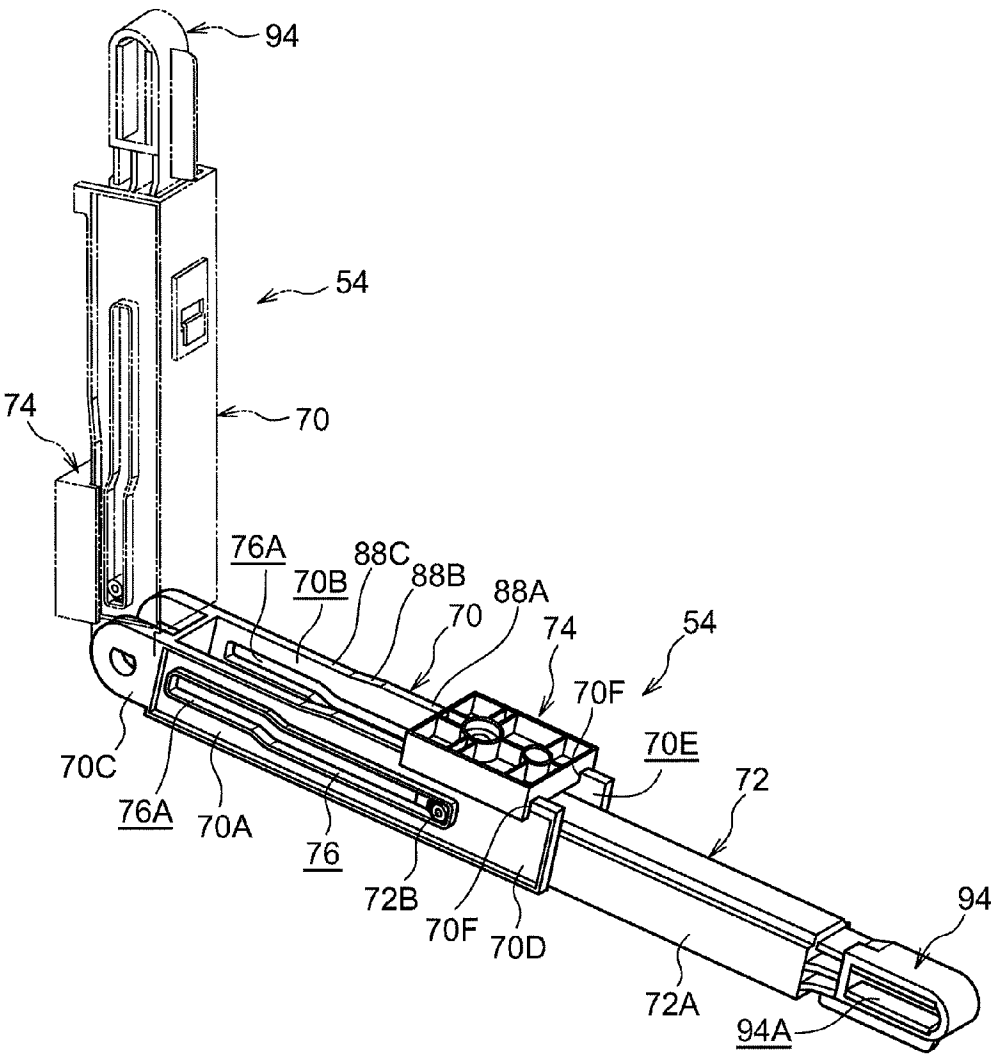
FIG. 4 is a perspective diagram showing the damper device.
Figure 5:
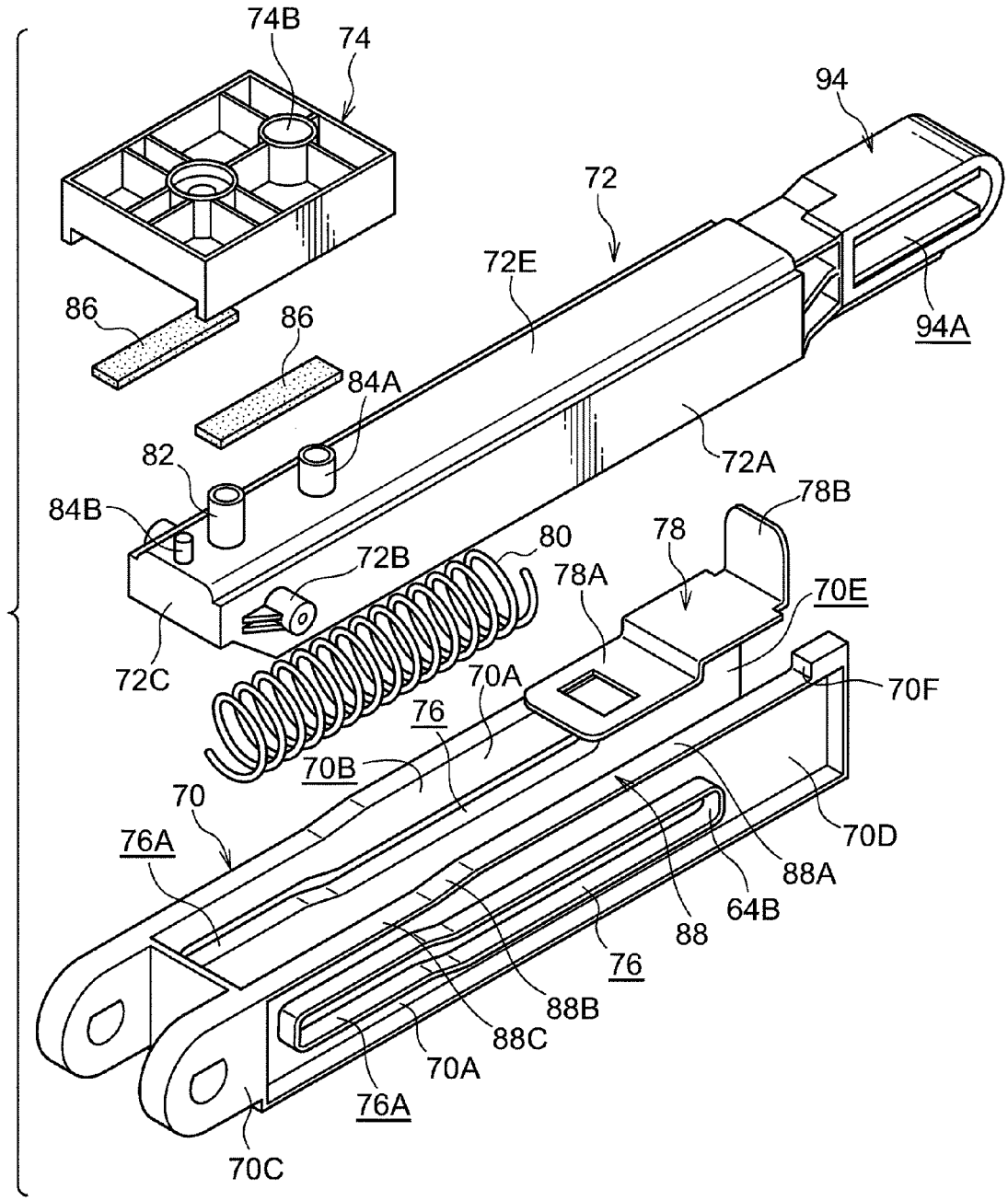
FIG. 5 is an exploded perspective diagram showing parts of the damper device.

As shown in FIG. 4 and FIG. 5, the holding member 70 is formed in a substantial U-shape when seen in a cross section orthogonal to its longitudinal direction, and is equipped with an open portion 70B that opens to upper sides of side wall portions 70A. A mounting portion 70C disposed on one end portion of the side wall portion 70A is rotatably coupled to the rotation support portion 68 (see FIG. 2), and the holding member 70 is equipped with an open portion 70E that opens to a side of a distal end portion 70D that is the other end portion of the side wall portion 70A. The sliding member 72 is inserted into width direction inner sides of the side wall portions 70A and slides along the longitudinal direction through the open portion 70E of the holding member 70.

Guide holes 76 are disposed along the longitudinal direction in the side wall portions 70A which are on both width direction sides of the holding member 70. End portions of the guide holes 76 on the side of the mounting portions 70C serve as offset portions 76A that are formed so as to be offset to the upper side of FIG. 4. Pins 72B disposed on side surface portions 72A of the sliding member 72 are inserted into these guide holes 76, whereby the sliding member 72 slides with respect to the holding member 70 in a state where the pins 72B are guided in the guide holes 76.

Figure 7:
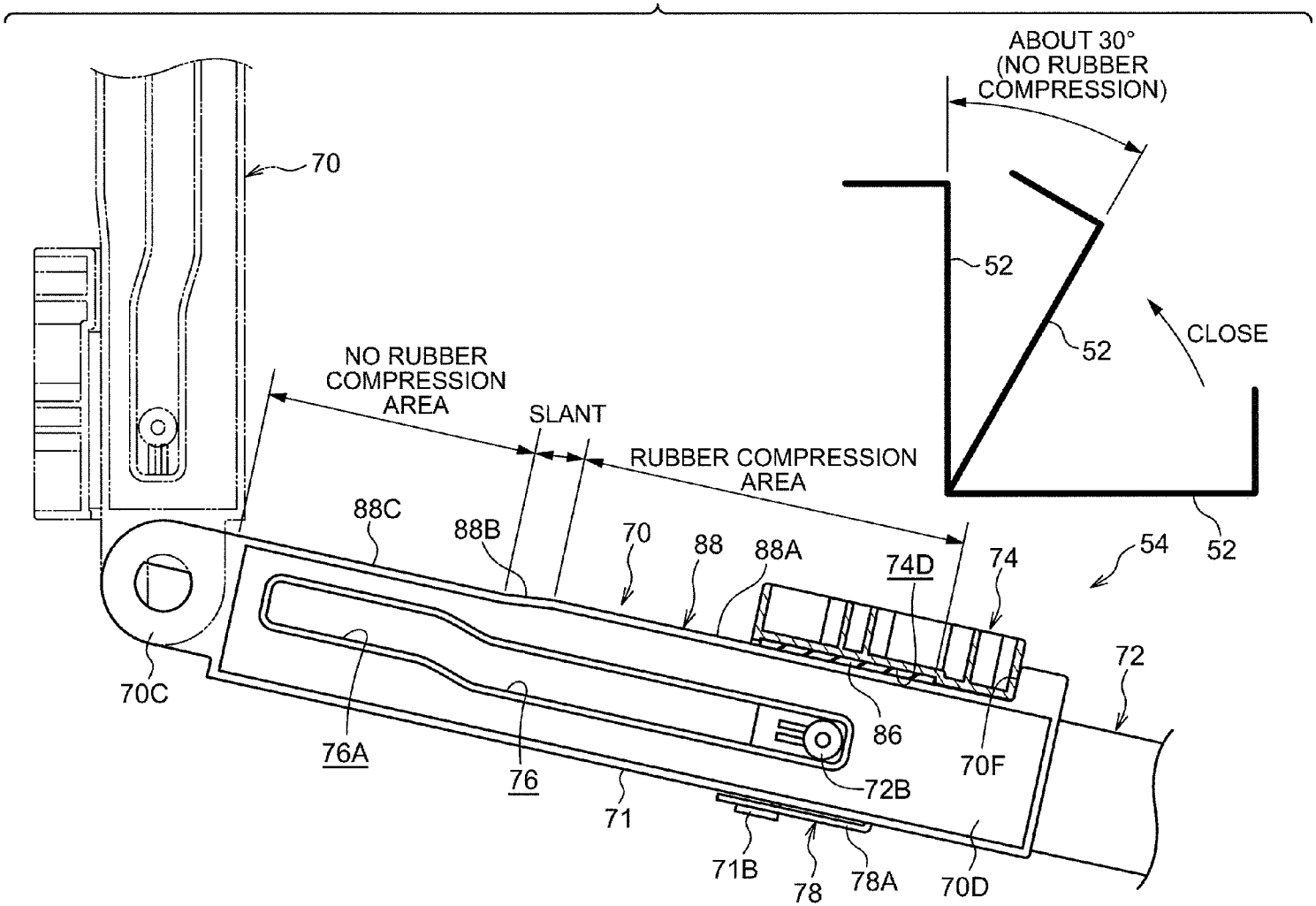
FIG. 7 is a cross-sectional diagram showing a holding member and the pressing member.
Figure 8:
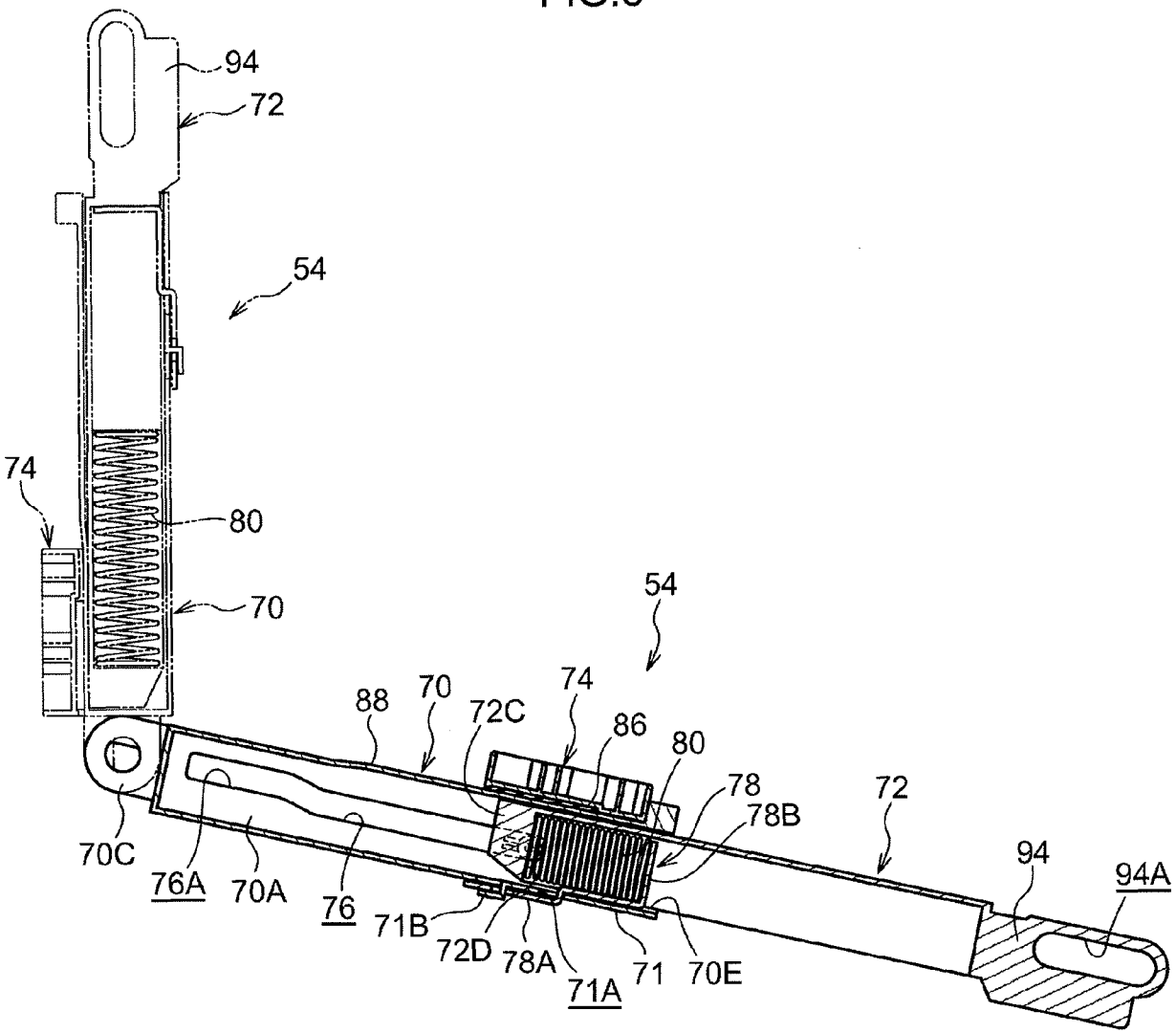
FIG. 8 is a cross-sectional diagram showing the damper device.
Figure 9:
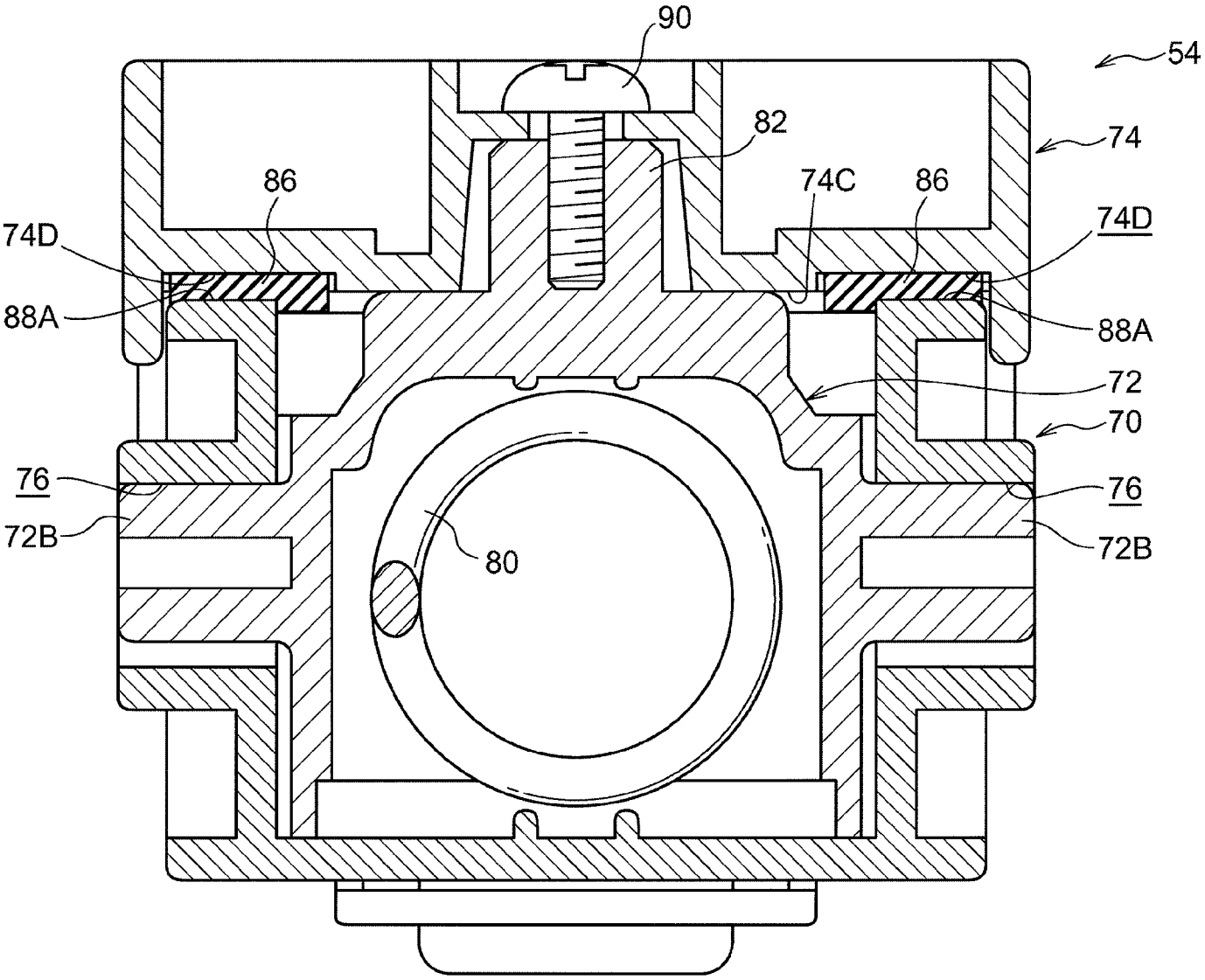
FIG. 9 is a cross-sectional diagram showing the damper device in a direction orthogonal to the longitudinal direction of the damper device while the opening-and-closing cover is being closed.
Figure 10:
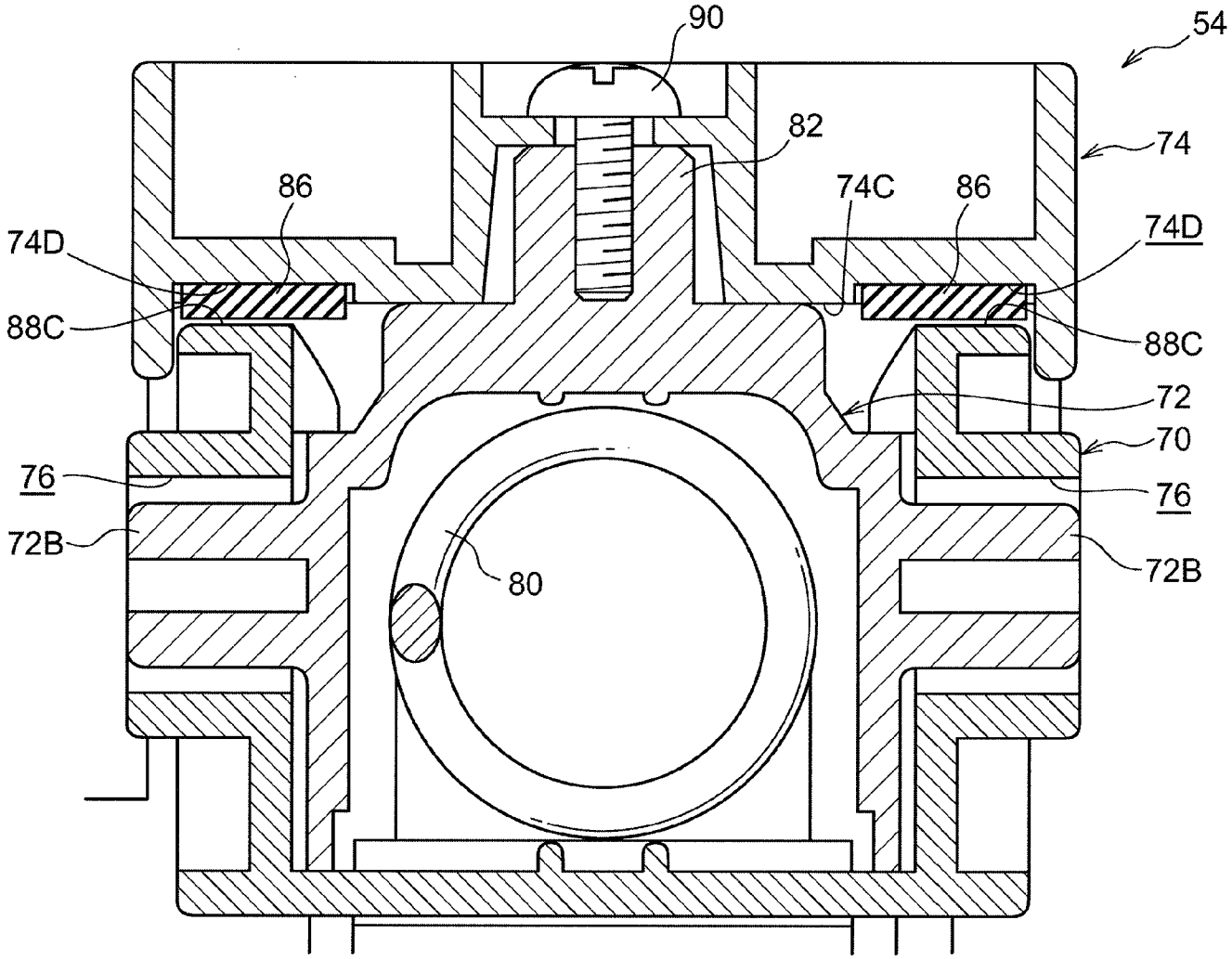
FIG. 10 is a cross-sectional diagram showing the damper device in a direction orthogonal to the longitudinal direction of the damper device at a time when the opening-and-closing cover is closed.

A support member 78 bent such that it has a substantially L-shaped cross section is inserted into width direction inner sides of the distal end portions 70D of the side wall portions 70A. As shown in FIG. 7 and FIG. 8, a mounting portion 78A disposed on one end portion of the support member 78 is bent below the side wall portions 70A, and the mounting portion 78A is passed through an opening 71A disposed in a lower surface portion 71 of the holding member 70 and is placed below the lower surface portion 71. The mounting portion 78A of the support member 78 is latched to a latch piece 71B that projects downward from the lower surface portion 71 of the holding member 70, whereby the support member 78 is fixed to the holding member 70. A plate-shaped latch portion 78B is disposed on the support member 78 in a direction where it closes the open portion 70E of the holding member 70.

The sliding member 72 has a substantially U-shaped cross section and opens downward. A compression coil spring 80 is placed between an inner wall surface 72D of a wall portion 72C that is one end portion of the sliding member 72 and the latch portion 78B of the support member 78 (see FIG. 8).

Further, a coupling portion 94 for coupling to a mounting portion 52B disposed on the opening-and-closing cover 52 (see FIG. 3) is disposed on the other end portion of the sliding member 72. A long hole 94A is formed in a side portion of this coupling portion 94 along the longitudinal direction of the sliding member 72. As shown in FIG. 2, a pin 52C disposed on the mounting portion 52B of the opening-and-closing cover 52 is inserted into the long hole 94A, whereby the coupling portion 94 of the sliding member 72 is coupled to the mounting portion 52B of the opening-and-closing cover 52 via the pin 52C inserted into the long hole 94A. The pin 52C moves inside the long hole 94A in accordance with the opening and closing operation of the opening-and-closing cover 52.

As shown in FIG. 5, cylindrical mounting portions 82, 84A and 84D for mounting the pressing member 74 are disposed on, so as to project from, a portion of an upper surface portion 72E of the sliding member 72 on the side near the side wall 72C.

Figure 6:
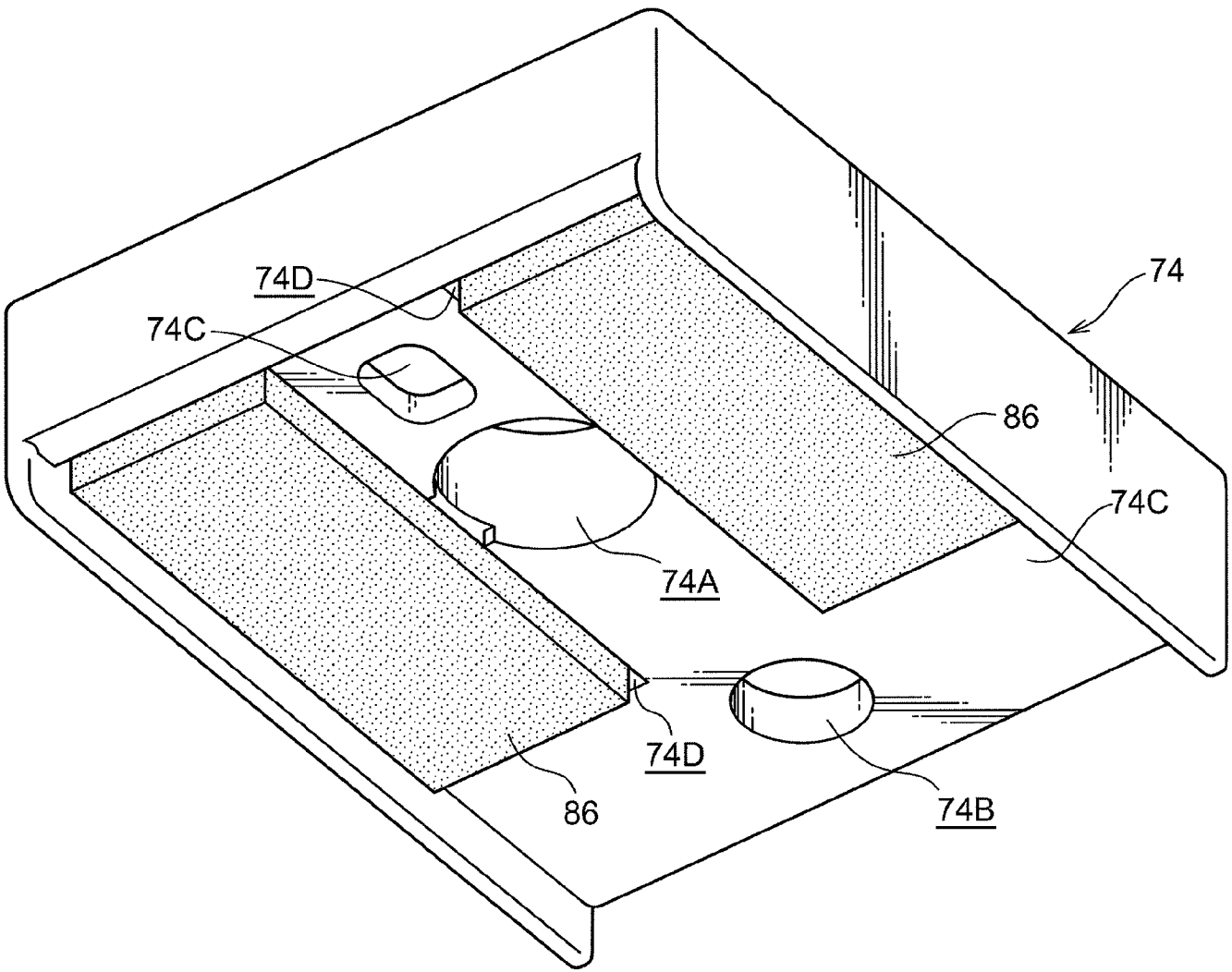
FIG. 6 is a perspective diagram showing a pressing member and pads as seen from below.

As shown in FIG. 5 and FIG. 6, in the rectangular shaped pressing member 74, there are disposed circular holes 74A, 74B and 74C into which the mounting portions 82, 84A and 84B of the sliding member 72 are inserted. The lower portion of the pressing member 74 is concavely recessed, and a planar portion 74C for mounting pads 86 serving as one example of braking member is formed in this recessed portion. Concave portions 74D are formed in both width direction sides of the planar portion 74C along the sliding direction of the sliding member 72. The concave portions 74D are formed to match the outer shapes of the tabular pads 86, and the pads 86 are inserted into the concave portions 74D and pasted to bottom surfaces of the concave portions 74D by an adhesive, double-sided tape or the like. The pads 86 are formed by members that have elasticity and whose resistance is large. In the present exemplary embodiment, synthetic rubber (e.g., urethane foam) is used. The pads 86 are inserted into the concave portions 74D and pasted by an adhesive or double-sided tape, whereby positional displacement of the pads 86 is suppressed when the pads 86 slide on sliding surfaces 88 serving as one example of sliding surfaces of the holding member 70.

The pressing member 74 is fastened and fixed to the mounting portion 82 by a bolt 90 (see FIG. 9) in a state where the circular holes 74B and 74C of the pressing member 74 are positioned around the mounting portions 84A and 84B of the sliding member 72, whereby the pressing member 74 is mounted on the sliding member 72. As shown in FIG. 7 and FIG. 8, the pressing member 74 slides integrally with the sliding member 72 with respect to the holding member 70, and when the sliding member 72 slides, the pads 86 that are pasted to the concave portions 74B of the pressing member 74 slide on the sliding surfaces 88, which are disposed on upper portions of the side wall portions 70A of the holding member 70.

As shown in FIG. 7, each of the sliding surfaces 88 is equipped with a high surface portion 88A that is formed on the side of the distal end portions 70D of the holding member 70 and whose height is high, a slanting surface 88B that is formed in the middle portion of the holding member 70 such that its height gradually becomes lower than the high surface portion 88A, and a low surface portion 88C that serves as one example of a compressional deformation releasing mechanism that is formed on the side of the mounting portions 70C of the holding member 70 such that it is continuous with the slanting surface 88B and such that its height is lower than that of the high surface portion 88A.

When the opening-and-closing cover 52 is moved to a closed position, the sliding member 72 slides in a direction where it goes inside (is accommodated in) the holding member 72. In accompaniment therewith, the pads 86 slide on the sliding surfaces 88 in the order of the high surface portions 88A, the slanting surfaces 88B and the lower surface portions 88C. Due to these sliding surfaces 88, the amount of compression of the pad 86 is large when the pad 86 slides on the high surface portion 88A (see FIG. 9), the amount of compression of the pad 86 gradually becomes smaller when the pad 86 slides on the slanting surface 88B, and the pad 86 is not compressed when the pad 86 reaches the low surface portion 88C (the compression of the pad 86 is released) (see FIG. 10).

In the present exemplary embodiment, when the opening-and-closing cover 52 is being moved to the closed position, the pads 86 reach the low surface portions 88C and are not compressed when the opening-and-closing cover 52 has rotated to a position of an open angle of 30° with respect to the closed position.

Figure 11:
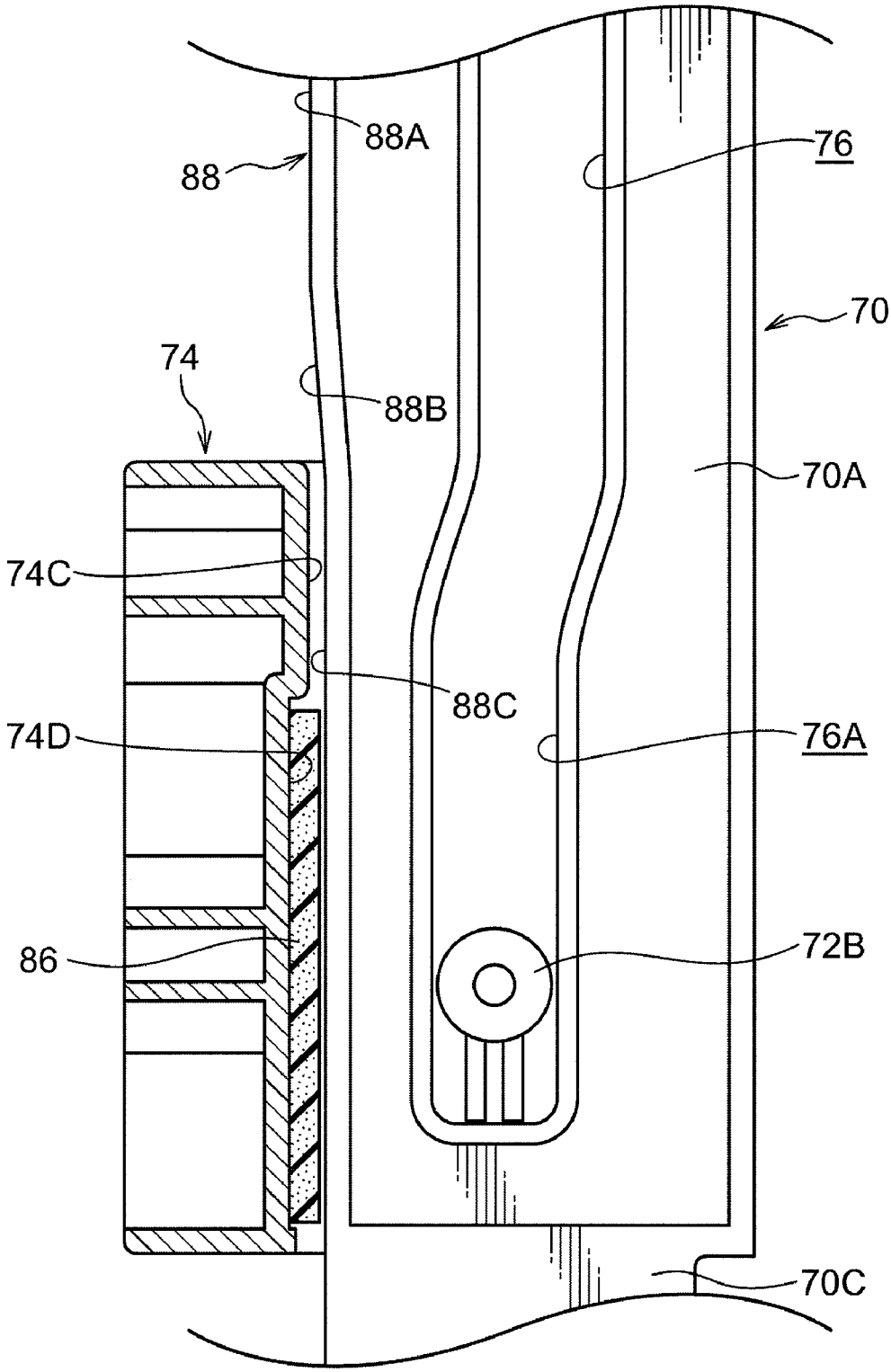
FIG. 11 is a cross-sectional diagram showing the holding member and the pressing member at a time when the opening-and-closing cover is closed.

Moreover, as shown in FIG. 11, in a state where the opening-and-closing cover 52 has moved to the closed position, the offset portion 76A, on the side of the guide hole 76, of the mounting portion 70C is disposed so as to extend on the side of the pressing member 74 (on the side of the image forming apparatus body 12 shown in FIG. 1) that has slid downward. That is, when the pin 72B of the sliding member 72 has moved to the offset portion 76A of the guide hole 76, the pressing member 74 is actively moved in a direction away from the low surface portion 88C of the holding member 70, whereby the pad 86 reliably moves away from the low surface portion 88C. Thus, when the opening-and-closing cover 52 has been closed, the pad 86 is not maintained in a compressed state.

That is, by the pin 72B of the sliding member 72 moving to the offset portion 76A, the sliding member 72 moves upwardly with respect to the holding member 70 (a distance between the sliding member 72 and the holding member 70 is changed) with an amount of offset by the offset portion 76A.

Accordingly, the pressing member 74 mounted to the sliding member 72 also moves upwardly with respect to the holding member 70 (a distance between the pressing member 74 and the holding member 70 is changed). That is, the pressing member 74 moves in a direction away from the sliding surface 88 (88C) of the holding member 70.

Further, the pressing member 74 is configured such that, by changing a stroke (degree) by which the bolt 90 is fastened to the mounting portion 82, the amount of compression when the pads 86 contact the sliding surfaces 88 can be adjusted. Thus, the frictional force when the pads 86 slide on the sliding surfaces 88 is capable of being changed. In particular, when the mass of the opening-and-closing cover 52 has been changed, such as when a recording sheet transport device for double-sided printing has been optionally mounted on the opening-and-closing cover 52, for example, the frictional force when the pads 86 slide on the sliding surfaces 88 is capable of being changed in accordance with the mass of the opening-and-closing cover 52 by changing the stroke by which the bolt 90 is fastened to the mounting portion 82.

Further, as shown in FIG. 5, end surfaces 64B of the guide holes 76 disposed in the holding member 70 on the side of the distal end portions 70D serve as stoppers that the pins 72B of the sliding member 72 abut when the opening-and-closing cover 52 has been opened. Further, wall portions 70F that project upward are disposed on the side of the distal end portions 70D of the side wall portions 70A of the holding member 70. The wall portions 70F regulate the sliding of the pressing member 74 when the opening-and-closing cover 52 has been opened.

As shown in FIG. 3, on the opposite side of the damper device 54 in the width direction of the opening-and-closing cover 52, there is disposed a strap 100 that supports the opening-and-closing cover 52 when the opening-and-closing cover 52 is opened and closed. The strap 100 supports the load with tension when the opening-and-closing cover 52 has moved to an open position, and the strap 100 becomes folded such that its resistance becomes smaller when the opening-and-closing cover 52 has moved to the closed position. Further, in the present exemplary embodiment, resin is used for the opening-and-closing cover 52. Metal or the like may also be used for the opening-and-closing cover 52.

Next, an operation of the opening-and-closing mechanism of the opening-and-closing cover 52 disposed in this image forming apparatus 10 will be described.

When the photoreceptor unit 14 or the like is to undergo maintenance, the opening-and-closing cover 52 is rotated in the opening direction to open the right side surface 12A of the image forming apparatus body 12 (see FIG. 2). At this time, because the damper device 54 is disposed on the opening-and-closing cover 52, the opening-and-closing cover 52 rotates gently in the opening direction (a clockwise direction indicated by arrows in FIG. 3).

Figure 12:
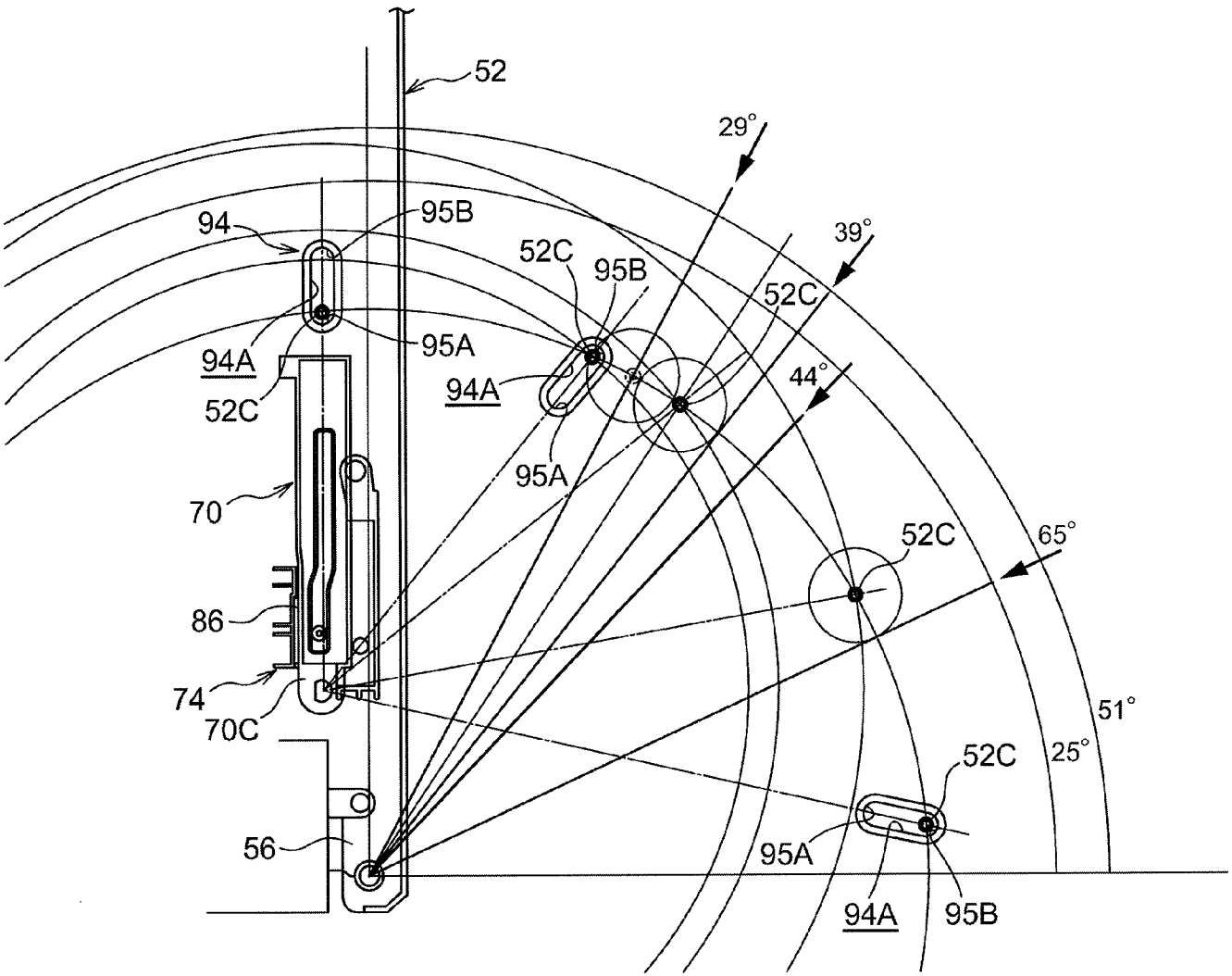
FIG. 12 is a general diagram describing states of the parts of the damper device while the opening-and-closing cover is being opened and closed.
Figure 13:
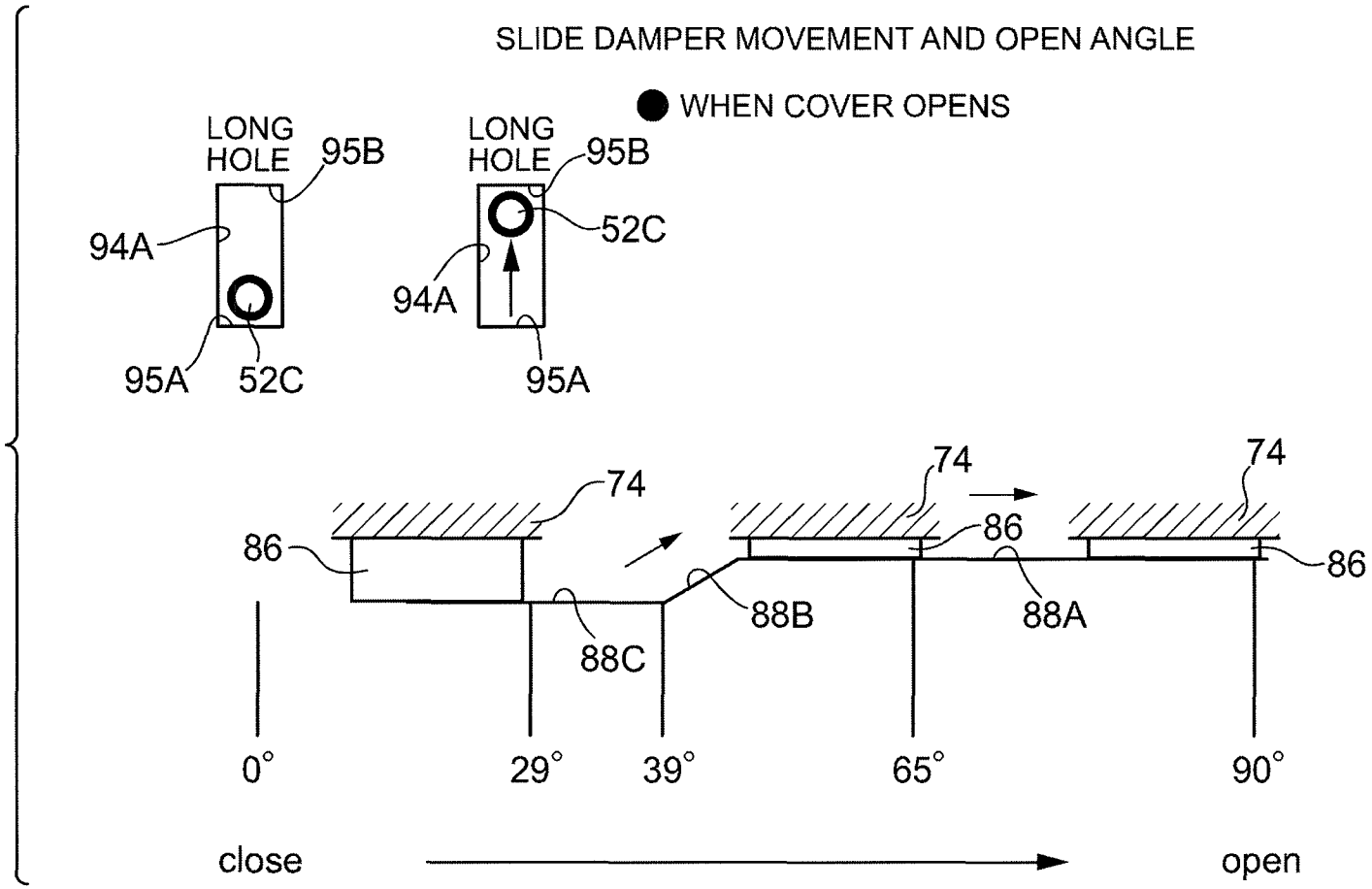
FIG. 13 is a general configuration diagram showing a state where the pads are pressed against the holding member in accompaniment with the opening operation of the opening-and-closing cover.

That is, in accompaniment with the rotation of the opening-and-closing cover 52 in the opening direction about the rotation support portion 58, the mounting portion 70C of the holding member 70 also rotates in the opening direction about the rotation support portion 68. At this time, because the coupling portion 94 of the sliding member 72 disposed so as to be slidable in the holding member 80 is coupled to the mounting portion 52B of the opening-and-closing cover 52 via the pin 52C inserted into the long hole 94A, as shown in FIG. 12 and FIG. 13, the pin 52C moves in a direction from one end portion 95A on the lower side of the long hole 94A to another end portion 95B on the upper side of the long hole 94A as the opening-and-closing cover 52 starts to rotate. In the present exemplary embodiment, the pin 52C moves to the other end portion 95B of the long hole 94A when the open angle of the opening-and-closing cover 52 becomes about 29°.

When the open angle of the opening-and-closing cover 52 becomes larger than about 29°, the sliding member 72 is pulled in the opening direction and begins to slide along the longitudinal direction with respect to the holding member 70. At this time, because the pad 86 of the pressing member 74 is proximate to and faces the low surface portion 88C of the holding member 70, so, the pad 86 is not compressed (see FIG. 10).

When the open angle of the opening-and-closing cover 52 becomes larger than about 39° (the damper device 54 is about 30°), the sliding member 72 further slides with respect to the holding member 70, and the pad 86 of the pressing member 74 slide on the high surface portion 88A from the slanting surface 88B of the sliding surface 88 of the holding member 70. At that time, the pad 86 of the pressing member 74 becomes compressionally deformed and slides from the slanting surface 88B to the high surface portion 88A, whereby a frictional force arises (braking force at the time of sliding becomes larger). In other words, the pad 86 of the pressing member 74 slides from the slanting surface 88B of the holding member 70 to the high surface portion 88A of the holding member 70 in a state where the pad 86 is compressionally deformed, whereby a braking force (sliding resistance) of the sliding member 72 with respect to the holding member 70 arises. Moreover, while the pad 86 of the pressing member 74 is sliding on the high surface portion 88A (when the open angle of the opening-and-closing cover 52 becomes larger than about 44°), the wall portion 72C of the sliding member 72 moves proximate to the latch portion 78B side (see FIG. 8), whereby the compression coil spring 80 is compressed.

When the open angle of the opening-and-closing cover 52 becomes larger than about 65°, the entire surface of the pad 86 of the pressing member 74 contacts the high surface portion 88A and slides on the high surface portion 88A in a state where the pad 86 is compressed.

In this damper device 54, the sliding member 72 slides gently with respect to the holding member 70 due to the elastic force of the compression coil spring 80 and the sliding resistance (frictional force) of the pad 86. Thus, in accordance with the opening-and-closing cover 52 rotating in the opening direction, the rotational speed of the opening-and-closing cover 52 gradually becomes slower and stops sue to the stopper (see FIG. 3). For this reason, the opening-and-closing cover 52 is not opened forcefully.

Figure 14:
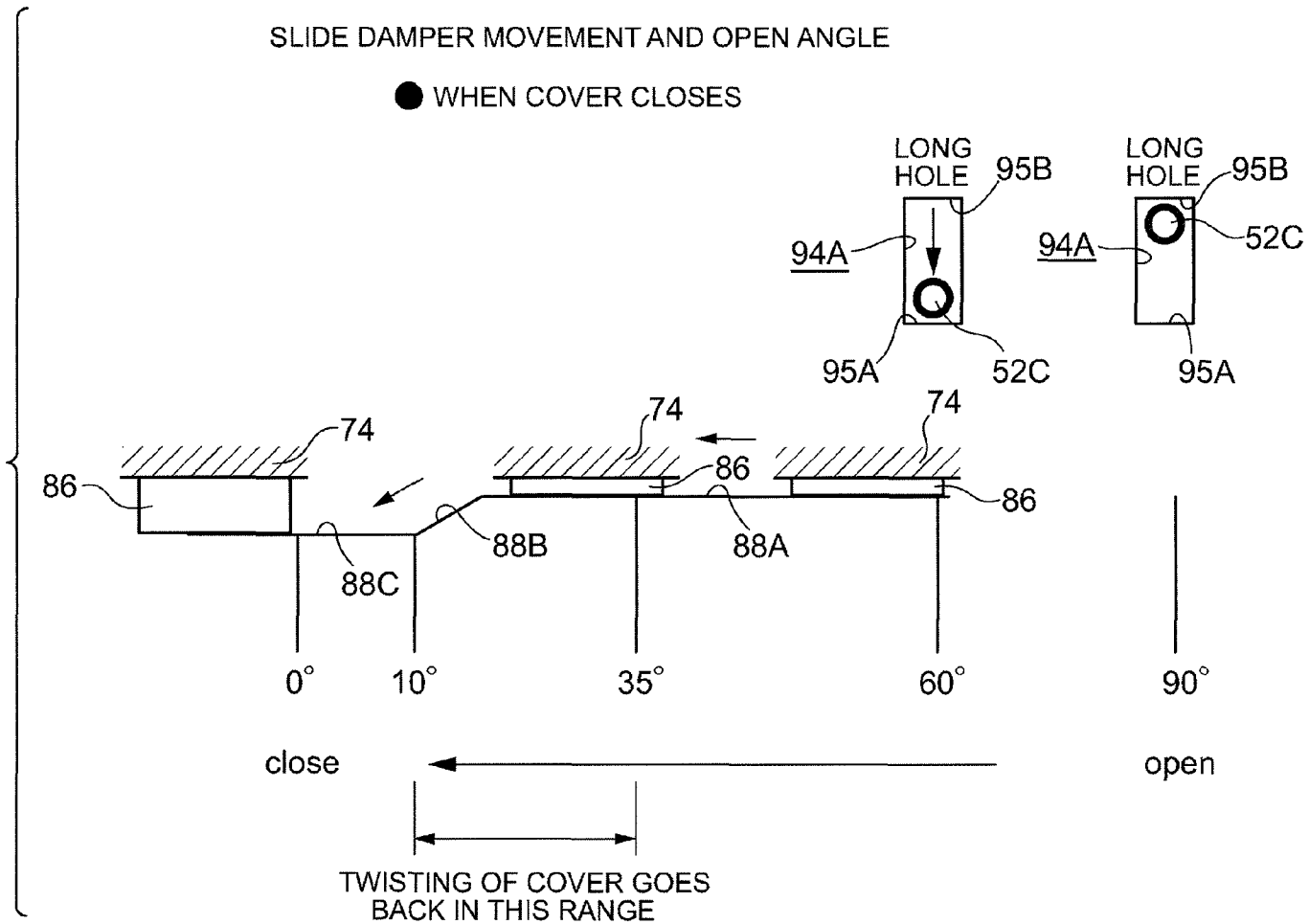
FIG. 14 is a general configuration diagram showing a state where the pads are pressed against the holding member in accompaniment with the closing operation of the opening-and-closing cover.
Figure 15:
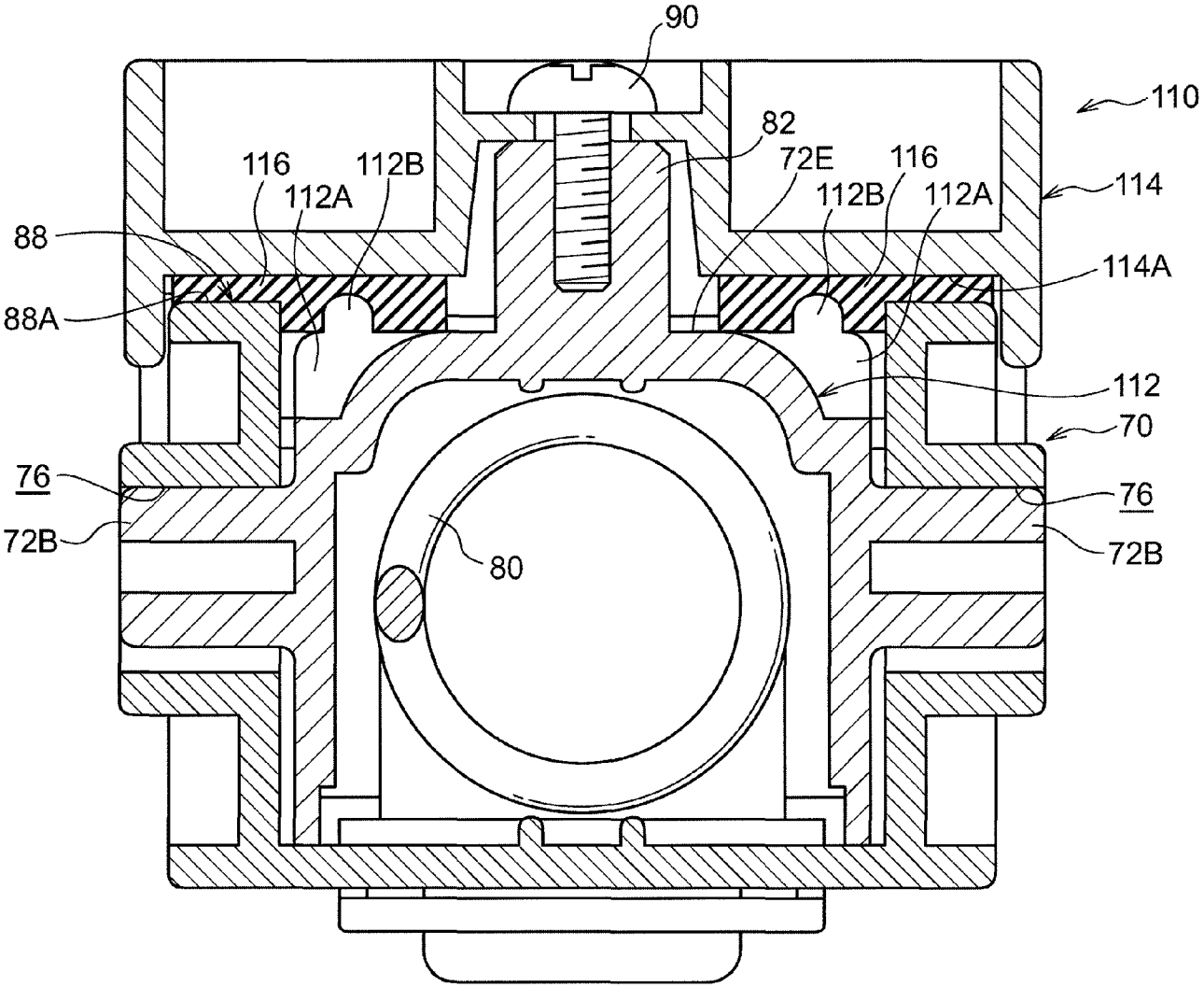
FIG. 15 is a cross-sectional diagram showing a damper device in a direction orthogonal to the longitudinal direction of the damper device which is used in an opening-and-closing mechanism pertaining to a second exemplary embodiment.
Figure 16:
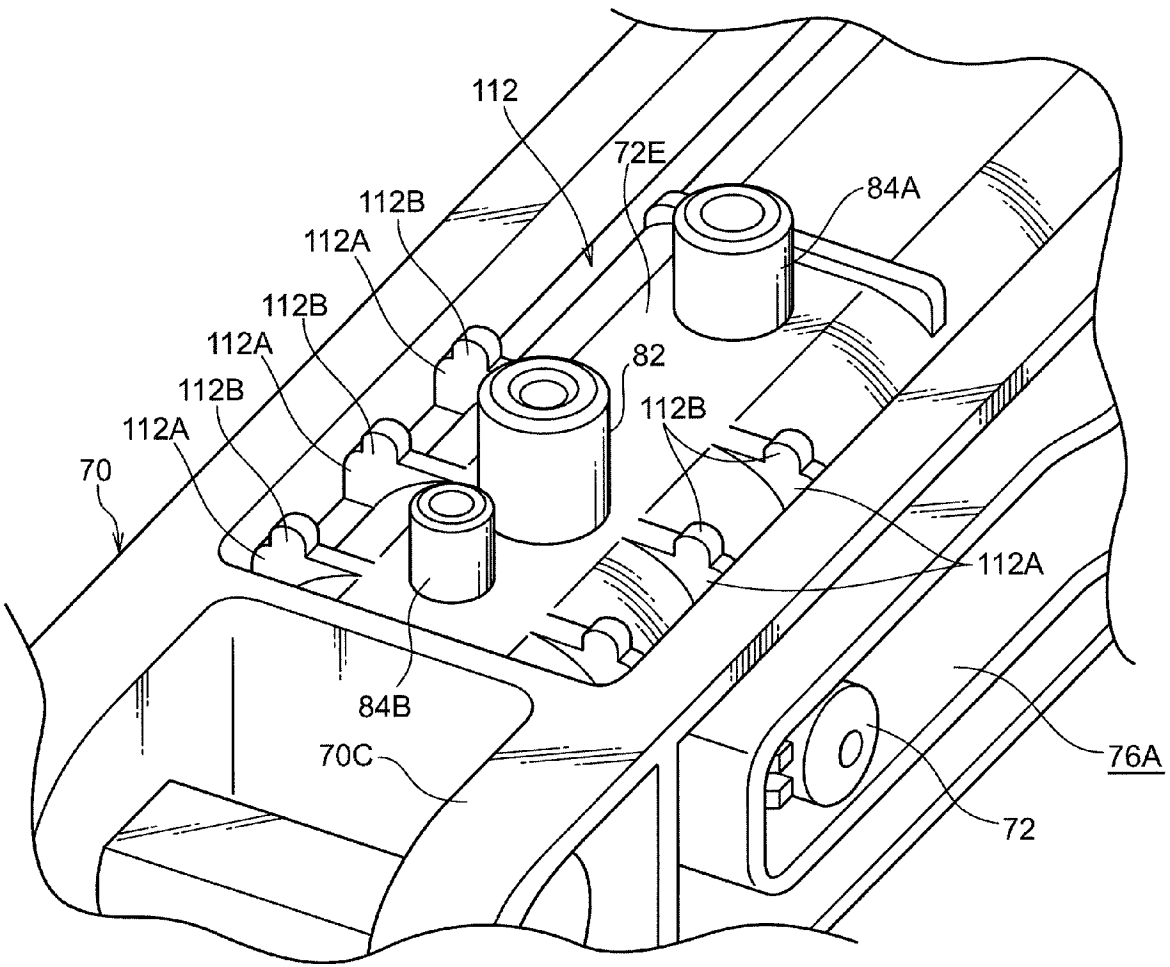
FIG. 16 is a perspective diagram showing a sliding member and the holding member.
Figure 17:
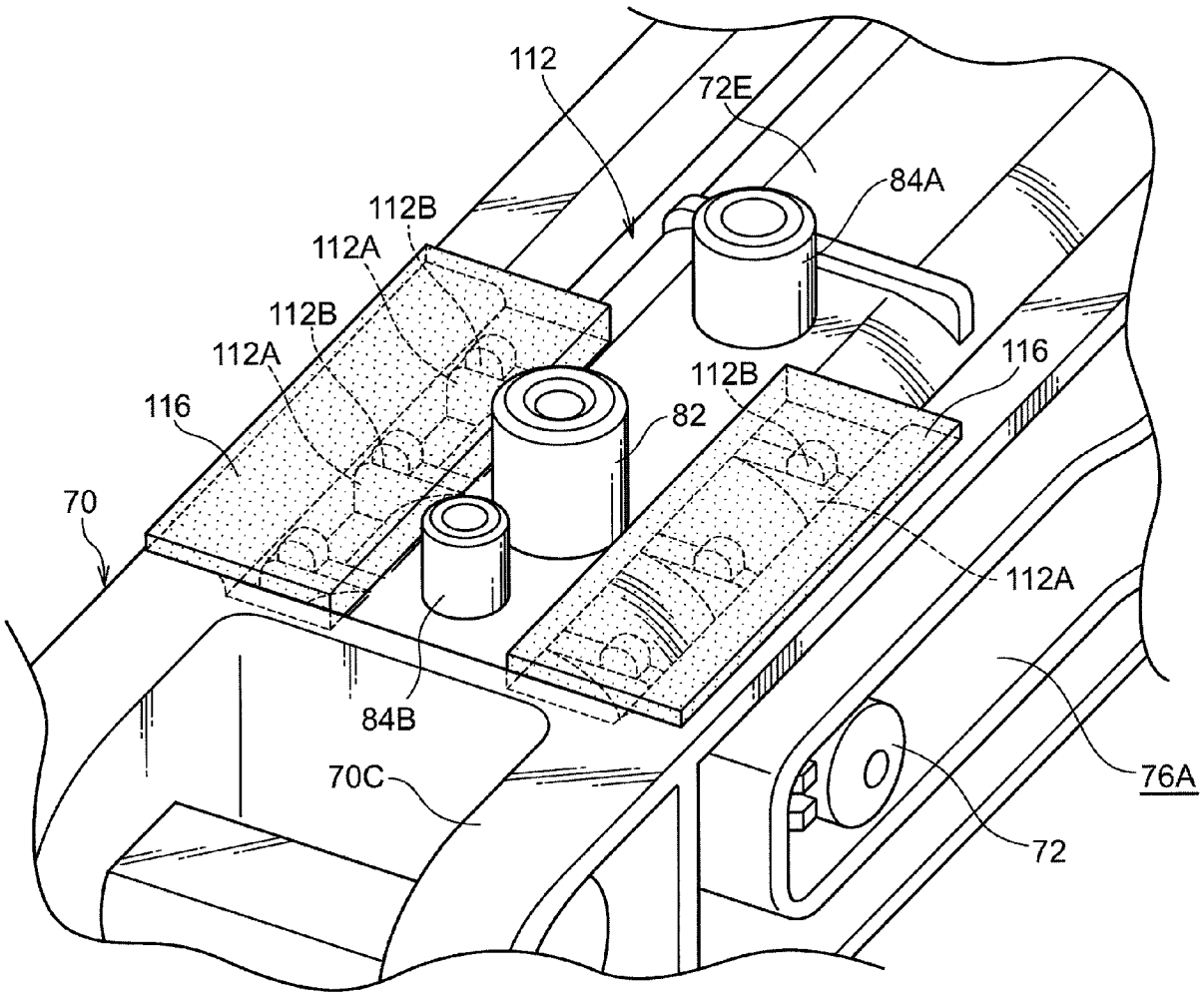
FIG. 17 is a perspective diagram showing the sliding member, pads and the holding member.
Figure 18:
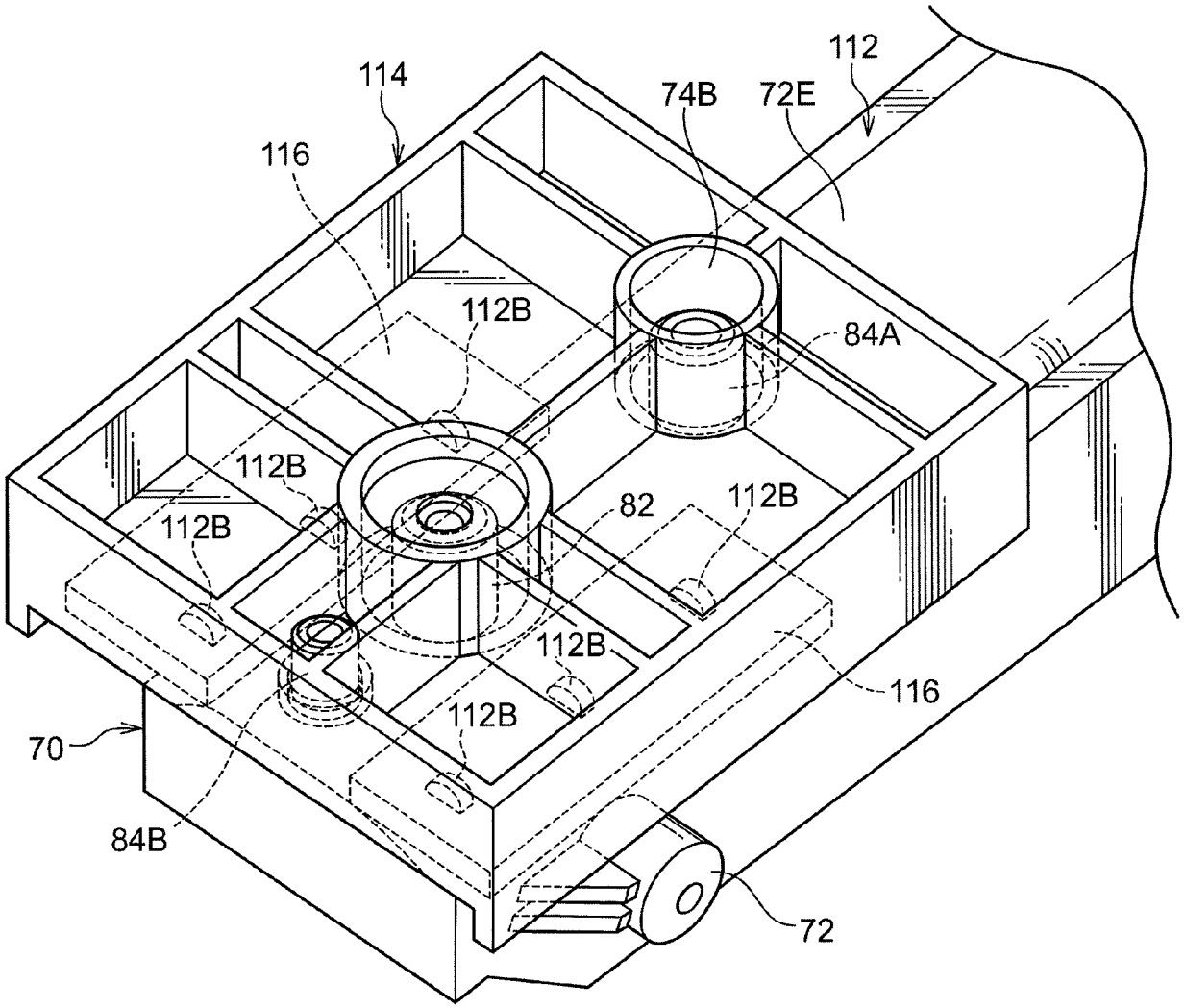
FIG. 18 is a perspective diagram showing the sliding member, a pressing member and the pads.

When maintenance work on the photoreceptor unit 14 or the like ends, the opening-and-closing cover 52 is rotated in the closing direction (a counter clockwise direction that is the opposite direction of the arrows in FIG. 3). At this time also, the opening-and-closing cover 52 gently rotates. That is, when the opening-and-closing cover 52 is rotated in the closing direction, the mounting portion 70C of the holding member 70 also rotates in the closing direction. As shown in FIG. 14, when the opening-and-closing cover 52 begins rotating, the pin 52C moves from the other end portion 95B of the long hole 94A to the one end portion 95A. In the present exemplary embodiment, the pin 52C moves to the one end portion 95A of the long hole 94A when the open angle of the opening-and-closing cover 52 becomes about 60°. At this time, the compression coil spring 80 is maintained in a compressed state.

When the open angle of the opening-and-closing cover 52 becomes smaller than about 60°, by being pushed by the mounting portion 52B of the opening-and-closing cover 52, the sliding member 72 begins sliding in the direction in which it goes (it is accommodated) into the holding member 70. At that time, the pad 86 of the pressing member 74 slides on the high surface portion 88A of the sliding surface 88 in a state where the pad 86 is compressionally deformed, and a frictional force arises (braking force at the time of sliding is large). At this time, the compression coil spring 80 extends such that the movement of the opening-and-closing cover 52 in the closing direction is assisted.

When the open angle of the opening-and-closing cover 52 becomes smaller than about 35°, a part of the pad 86 of the pressing member 74 begins sliding on the slanting surface 88B of the sliding surface 88. Moreover, when the open angle of the opening-and-closing cover 52 becomes smaller than about 10°, the pad 86 of the pressing member 74 reaches the low surface portion 88C, and the compression of the pad 86 by the sliding surface 88 is released (disappears).

The damper device 54 is disposed on one width direction end portion of the opening-and-closing cover 52, and the pad 86 of the pressing member 74 slides on the high surface portion 88A and resistance becomes larger when closing the opening-and-closing cover 52, so, sometimes, twisting may occur in the opening-and-closing cover 52 when the end portion of the opening-and-closing cover 52 on the side where the damper device 54 is not disposed (the side where resistance accompanying rotation is small) being pushed to close the opening-and-closing cover 52. At that time, in the damper device 54, a part of the pad 86 of the pressing member 74 slides on the slanting surface 88B of the sliding surface 88 and moves to the low surface portion 88C, thereafter, twisting goes back (is released) in the opening-and-closing cover 52 whereby deformation of the opening-and-closing cover 52 in the closed attitude of the opening-and-closing cover 52 is suppressed.

The opening-and-closing cover 52 is opened and closed as described above, but sometimes a transport unit for double-sided printing is optionally disposed on the inner surface side of the opening-and-closing cover 52. In a case where a transport unit for double-sided printing is disposed, the weight of the opening-and-closing cover 52 increases, so there is the fear that the opening-and-closing cover 52 will be opened forcefully. However, in this damper device 54, the amount of compression of the pads 86 is adjusted by changing the fastening stroke of the bolt 90 that fixes the pressing member 74 to the sliding member 72, so the sliding of the sliding member 72 with respect to the holding member 70 becomes even gentler, and the opening operation of the opening-and-closing cover 52 is performed gently.

Next, a second exemplary embodiment of the opening-and-closing device of the invention will be described.

The same reference numerals will be given to members that are the same as those in the first exemplary embodiment, and redundant description of those same members will be omitted. Further, the overall configuration of the image forming apparatus is the same as that in the first exemplary embodiment, so description thereof will be omitted.

As shown in FIG. 15 to FIG. 18, on both width direction sides of the upper surface portion 72E of a sliding member 112 disposed in a damper device 110, plural ribs 112A are disposed along the longitudinal direction in positions facing pads 116. Projections 112B are formed on upper portions of the rubs 112A. The projections 112B are formed in shapes whose upper surfaces project in substantial U-shapes. In the present exemplary embodiment, three of the ribs 112A each are disposed on both width direction sides of the sliding member 112 along the longitudinal direction, and the projections 112B are formed on each of the ribs 112A.

On a lower portion of a pressing member 114, there is disposed a planar portion 114A on which the pads 116 are mounted. The pads 116 are adhered by an adhesive or the like to the planar portion 114A. In the pressing member 114 of the present exemplary embodiment, the concave portions 74D in the pressing member 74 (see FIG. 9) of the first exemplary embodiment are not provided.

In the present exemplary embodiment, the width direction (direction orthogonal to the longitudinal direction of the sliding member 112) width of the pad 116 is larger as compared to that of the pad 86 (see FIG. 9) of the first exemplary embodiment, and the projections 112B of the sliding member 112 eat into (strongly push so as to deform) the pads 116 in a state where the pressing member 114 is fastened and fixed by the bolt 90 to the sliding member 112. The distal ends of the projections 112B may also be made more cuspate such that the projections 112B stick into the pads 116.

In this damper device 110, the projections 112B of the sliding member 112 eat into the pads 116 in a state where the pressing member 114 is fastened and fixed by the bolt 90 to the sliding member 112, so displacement of the pads 116 is suppressed when the pads 116 slide on the sliding surfaces 88 of the holding member 70 in a state where the pads 116 are compressionally deformed. Further, due to the projections 112B eat into the pads 116, they are not against the compression direction of the pads 116 and it is difficult for them to affect the compressional deformation of the pads 116.

The invention has been described in detail on the basis of particular embodiments, but it will be understood by those skilled in the art that the invention is not limited to these embodiments and that other various embodiments are possible within the scope of the invention. For example, in the first and second exemplary embodiments, the pressing members 74 and 114 are fixed to the sliding member 72 and the pads 86 and 116 disposed on the pressing members 74 and 114 are slid on the sliding surfaces 88 of the holding member 70, but the invention is not limited to this configuration. The pressing member may also be fixed to the holding member and the pads disposed on the pressing member may also be slid on sliding surfaces of the sliding member.

Further, material of the pads 86 and 116 is not limited so long as coefficient of friction between the pad and one of the sliding member or the holding member is larger than coefficient of friction between the other of the sliding member or the holding member and the one of the sliding member or the holding member.

Further, the position where the pressing member is mounted is not limited to being above the sliding member 72 shown in FIG. 7. The pressing member may also be mounted on the side or under the sliding member or the holding member.

In the first and second exemplary embodiments, the high surface portions 88A, the slanting surfaces 88B and the low surface portions 88C are disposed on the sliding surfaces 88 of the holding member 70, but the invention is not limited to this configuration. For example, three or more surfaces of different heights or slanting surfaces that are long in the longitudinal direction may also be disposed.

In the first and second exemplary embodiments, the damper device is disposed on one width direction end portion of the opening-and-closing cover 52, but the invention is not limited to this. The damper device may also be disposed on both width direction sides of the opening-and-closing cover 52.

In the first and second exemplary embodiments, the damper device is disposed on the opening-and-closing cover 52 that rotates about the rotation support portion 58 disposed in the lower portion of the image forming apparatus body 12, but the invention is not limited to this configuration. For example, the damper device may also be used on an opening-and-closing cover having a configuration where the opening-and-closing cover opens and closes the side surface of the apparatus body about rotation support portion disposed in the upper portion of the image forming apparatus body 12. Further, the damper device may also be disposed on an opening-and-closing cover that rotates about rotation support portion disposed in the middle portion of the image forming apparatus body 12. Further, the invention is not limited to the image forming apparatus 10. The damper device may also be disposed on an opening-and-closing cover disposed on the body of another apparatus.

Further, as shown in FIG. 5, the pad(s) may also be disposed along the moving direction of the pin 52C on the inner side of the long hole 94A to suppress initial velocity at the time when the opening-and-closing cover 52 is opened.

What is claimed is:

1. An opening-and-closing mechanism comprising:

an opening-and-closing member that rotates about a rotational center with respect to a body to thereby open and close one surface of the body;

a holding member that is disposed on the body and is rotatably coupled in a position that is displaced in a vertical direction with respect to the rotational center;

a sliding member that is disposed so as to be slidable with respect to the holding member along a longitudinal direction of the holding member, whose end portion is coupled to the opening-and-closing member, and that slides with respect to the holding member in accompaniment with rotation of the opening-and-closing member;

a braking member that is formed by a material that has elasticity and whose coefficient of friction with one of the sliding member or the holding member is larger than a coefficient of friction between the other of the sliding member or the holding member and the one of the sliding member or the holding member, the braking member sliding with respect to the one of the sliding member or the holding member in accompaniment with the sliding member sliding with respect to the holding member to thereby generate a braking force by a frictional force with the one of the sliding member or the holding member; and a pressing member that is disposed on the other of the sliding member or the holding member, the braking member being mounted at the pressing member, and the pressing member pressing the braking member against the one of the sliding member or the holding member.

2. The opening-and-closing mechanism of claim 1, wherein a height of a sliding surface of the one of the sliding member or the holding member, against which the braking member is pressed, is changed in a continuous manner or in a stepped manner so as to increase an amount of compression of the braking member in accompaniment with the opening-and-closing member being rotated in a direction where the opening-and-closing member opens the one surface.

3. The opening-and-closing mechanism of claim 2, further comprising a fixing member that fixes the pressing member to the other of the sliding member or the holding member so as to make an amount of pressing of the braking member against the one of the sliding member or the holding member adjustable.

4. The opening-and-closing mechanism of claim 2, wherein a compressional deformation releasing mechanism that releases compressional deformation of the braking member so as to put the braking member in a free state before the opening-and-closing member closes the one surface is provided at the one of the sliding member or the holding member.

5. The opening-and-closing mechanism of claim 1, further comprising a fixing member that fixes the pressing member to the other of the sliding member or the holding member so as to make an amount of pressing of the braking member against the one of the sliding member or the holding member adjustable.

6. The opening-and-closing mechanism of claim 5, wherein a compressional deformation releasing mechanism that releases compressional deformation of the braking member so as to put the braking member in a free state before the opening-and-closing member closes the one surface is provided at the one of the sliding member or the holding member.

7. The opening-and-closing mechanism of claim 1, wherein a compressional deformation releasing mechanism that releases compressional deformation of the braking member so as to put the braking member in a free state before the opening-and-closing member closes the one surface is provided at the one of the sliding member or the holding member.

8. The opening-and-closing mechanism of claim 1, wherein a projection that pushes the braking member so as to deform the braking member or sticks into the braking member is disposed in a position on the other of the sliding member or the holding member where the braking member is to be attached.

9. The opening-and-closing mechanism of claim 1, wherein the pressing member is disposed on the sliding member and the braking member is pressed against the holding member.

10. The opening-and-closing mechanism of claim 1, wherein the holding member, the sliding member, the braking member and the pressing member are disposed on one end side in a width direction of the opening-and-closing member.

11. The opening-and-closing mechanism of claim 1, wherein the rotational center about which the opening-and-closing member is opened and closed is disposed in a lower portion of the body, and the holding member is rotatably coupled to the body in the position which is above the rotational center.

12. The opening-and-closing mechanism of claim 1, wherein, in a direction orthogonal to the longitudinal direction of the holding member, a distance between the pressing member at which the braking member is mounted and the one of the sliding member or the holding member is changed by the sliding member sliding with respect to the holding member such that a distance of the sliding member and the holding member when the one surface of the body is closed by the opening-and-closing member and a distance of the sliding member and the holding member when the one surface of the body is opened by the opening-and-closing member are different.

13. The opening-and-closing mechanism of claim 1, wherein the holding member is rotatably coupled in the position which is covered by the opening-and-closing member.

14. An image forming apparatus comprising:

an opening-and-closing mechanism including an opening-and-closing member that rotates about a rotational center with respect to a body to thereby open and close one surface of the body;

a holding member that is disposed on the body and is rotatably coupled in a position that is displaced in a vertical direction with respect to the rotational center;

a sliding member that is disposed so as to be slidable with respect to the holding member along a longitudinal direction of the holding member, whose end portion is coupled to the opening-and-closing member, and that slides with respect to the holding member in accompaniment with rotation of the opening-and-closing member;

a braking member that is formed by a material that has elasticity and whose coefficient of friction with one of the sliding member or the holding member is larger than a coefficient of friction between the other of the sliding member or the holding member and the one of the sliding member or the holding member, the braking member sliding with respect to the one of the sliding member or the holding member in accompaniment with the sliding member sliding with respect to the holding member to thereby generate a braking force by a frictional force with the one of the sliding member or the holding member; and a pressing member that is disposed on the other of the sliding member or the holding member, the braking member being mounted at the pressing member, and the pressing member pressing the braking member against the one of the sliding member or the holding member;

an image forming unit that is disposed in the body and forms an image on a recording medium; and a transport unit that is disposed in the body and transports the recording medium to the image forming unit.

* * * * *